US009431723B2

(12) United States Patent
Chikusa

(10) Patent No.: US 9,431,723 B2
(45) Date of Patent: Aug. 30, 2016

(54) FEMALE TERMINAL FITTING

(71) Applicant: Sumitomo Wiring Systems, Ltd., Yokkaichi, Mie (JP)

(72) Inventor: Takahiro Chikusa, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/768,768

(22) PCT Filed: Feb. 18, 2014

(86) PCT No.: PCT/JP2014/053691
§ 371 (c)(1),
(2) Date: Aug. 19, 2015

(87) PCT Pub. No.: WO2014/129434
PCT Pub. Date: Aug. 28, 2014

(65) Prior Publication Data

US 2016/0006143 A1 Jan. 7, 2016

(30) Foreign Application Priority Data

Feb. 19, 2013 (JP) ..... 2013-029626

(51) Int. Cl.
*H01R 4/48* (2006.01)
*H01R 13/11* (2006.01)

(52) U.S. Cl.
CPC ..... *H01R 4/48* (2013.01); *H01R 13/113* (2013.01)

(58) Field of Classification Search
CPC ..... H01R 13/113; H01R 4/48
USPC ..... 439/852
See application file for complete search history.

(56) References Cited

U.S. PATENT DOCUMENTS 4,838,816 A * 6/1989 Matsusaka ..... H01R 13/193 493/395
5,112,254 A * 5/1992 Endo ..... H01R 43/16 439/852
5,350,321 A * 9/1994 Takenouchi ..... H01R 13/115 439/839
5,443,592 A * 8/1995 Ittah ..... H01R 13/113 439/839

(Continued)

FOREIGN PATENT DOCUMENTS

JP 1-106084 7/1969
JP 60-99783 7/1985

(Continued)

OTHER PUBLICATIONS

International Search Report.

*Primary Examiner* — Ross Gushi
(74) *Attorney, Agent, or Firm* — Gereald E. Hespos; Michael J. Porco; Matthew T. Hespos

(57) ABSTRACT

A female terminal fitting (10) is provided with a tubular main body portion (20) into which a mating male tab (90) is to be inserted, and a resilient contact piece (21) deflectably arranged in the main body portion (20). The resilient contact piece (21) is resiliently deformed toward a base wall (22) of the main body portion (20) to resiliently come into contact with the male tab (90) when the male tab (90) is inserted into the main body portion (20). An excessive deflection regulating piece (33) for regulating excessive deflection of the resilient contact piece (21) by coming into contact with the base wall (22) of the main body portion (20) is integrally provided to the resilient contact piece (21).

5 Claims, 4 Drawing Sheets

(56) References Cited

U.S. PATENT DOCUMENTS 5,540,603 A * 7/1996 Fujiwara ..... H01R 13/11 439/839
5,562,501 A * 10/1996 Kinoshita ..... H01R 13/113 439/851
5,601,458 A * 2/1997 Ohsumi ..... H01R 13/187 439/851
5,611,715 A * 3/1997 Samejima ..... H01R 13/113 439/850
5,791,945 A * 8/1998 Myer ..... H01R 13/113 439/852
5,839,925 A * 11/1998 Simmons ..... H01R 13/4364 439/595
5,941,741 A * 8/1999 Dobbelaere ..... H01R 13/113 439/852
6,019,646 A * 2/2000 Okamura ..... H01R 13/113 439/748
6,062,918 A * 5/2000 Myer ..... H01R 13/187 439/833
6,152,788 A * 11/2000 Hata ..... H01R 13/113 439/51
6,290,553 B1 * 9/2001 Sato ..... H01R 13/187 439/843
6,293,833 B1 * 9/2001 Kamath ..... H01R 13/113 439/839
6,305,992 B1 * 10/2001 Bouda ..... H01R 13/113 439/834
6,364,722 B1 * 4/2002 Yamamoto ..... H01R 13/113 439/850
6,475,040 B1 * 11/2002 Myer ..... H01R 13/11 439/374
6,478,636 B1 * 11/2002 Makita ..... H01R 13/113 439/852
6,506,084 B2 * 1/2003 Saitoh ..... H01R 13/11 439/843
6,520,811 B2 * 2/2003 Mitani ..... H01R 13/113 439/843
6,524,143 B2 * 2/2003 Chen ..... H01R 13/187 439/852
6,527,601 B2 * 3/2003 Chen ..... H01R 13/187 439/851
6,547,608 B2 * 4/2003 Sato ..... H01R 13/11 439/851
6,645,003 B2 * 11/2003 Yoshida ..... H01R 29/00 439/507
6,736,684 B2 * 5/2004 Ishiyama ..... H01R 13/187 439/852
6,971,927 B2 * 12/2005 Anbo ..... H01R 13/113 439/852
7,144,281 B2 * 12/2006 Maeda ..... H01R 43/16 439/595
7,156,704 B2 * 1/2007 Shimizu ..... H01R 13/113 439/852
7,229,329 B2 * 6/2007 Yamashita ..... H01R 13/11 439/595
7,252,564 B1 * 8/2007 Morello ..... H01R 4/185 439/843
7,347,747 B2 * 3/2008 Shimizu ..... H01R 13/11 439/842
7,387,550 B2 * 6/2008 Myer ..... H01R 13/113 439/852
7,458,864 B2 * 12/2008 Philipp ..... H01R 13/113 439/851
7,938,695 B2 * 5/2011 Furutani ..... H01R 4/185 439/852
8,021,200 B2 * 9/2011 Myer ..... H01R 13/113 439/857
8,043,130 B2 * 10/2011 Casses ..... H01R 13/11 439/850
8,118,621 B2 * 2/2012 Fukase ..... H01R 13/113 439/852
8,241,076 B2 * 8/2012 Kubota ..... H01R 13/113 439/852
8,241,077 B2 * 8/2012 Suzuki ..... H01R 13/114 439/839
8,333,622 B2 * 12/2012 Blasko ..... H01R 13/113 439/595
8,371,883 B2 * 2/2013 Kimura ..... H01R 13/113 439/852
8,454,394 B2 * 6/2013 Iihoshi ..... H01R 13/11 439/845
8,662,935 B2 * 3/2014 Jouas ..... H01R 13/113 439/660
8,784,144 B2 * 7/2014 Hirabayashi ..... H01R 13/113 439/852
8,821,197 B2 * 9/2014 Muro ..... H01R 13/113 439/830
8,845,362 B2 * 9/2014 Chikusa ..... H01R 13/4223 439/595
8,858,259 B2 * 10/2014 Chikusa ..... H01R 13/4223 439/595
8,905,798 B2 * 12/2014 Amano ..... H01R 4/48 439/817
8,911,253 B2 * 12/2014 Myer ..... H01R 13/113 439/561
8,944,861 B2 * 2/2015 Amano ..... H01R 13/11 439/852
8,974,256 B2 * 3/2015 Okano ..... H01R 13/11 439/852
8,998,656 B2 * 4/2015 Amano ..... H01R 13/113 439/845
9,011,186 B2 * 4/2015 Wirth ..... H01R 13/112 439/843
9,099,796 B2 * 8/2015 Myer ..... H01R 13/113
9,118,130 B1 * 8/2015 Volpone ..... H01R 13/113
9,236,675 B2 * 1/2016 Tsuji ..... H01R 13/187
2001/0002350 A1 * 5/2001 Kashiyama ..... H01R 13/11 439/848
2001/0051472 A1 * 12/2001 Sato ..... H01R 13/11 439/852
2002/0076999 A1 * 6/2002 Chen ..... H01R 13/187 439/851
2003/0190847 A1 * 10/2003 Nankou ..... H01R 13/113 439/852
2003/0224668 A1 * 12/2003 Matsuda ..... H01R 13/113 439/839
2004/0224573 A1 * 11/2004 Yoshida ..... H01R 13/11 439/852
2005/0227551 A1 * 10/2005 Tabata ..... H01R 13/113 439/852
2007/0099520 A1 * 5/2007 Anbo ..... H01R 4/185 439/852
2007/0218733 A1 * 9/2007 Philipp ..... H01R 13/113 439/188
2008/0070452 A1 * 3/2008 Komiyama ..... H01R 13/113 439/852
2010/0029146 A1 * 2/2010 Myer ..... H01R 13/15 439/852
2010/0130075 A1 * 5/2010 Casses ..... H01R 43/16 439/852
2010/0197177 A1 * 8/2010 Myer ..... H01R 13/113 439/852
2012/0142233 A1 * 6/2012 Blasko ..... H01R 13/113 439/852
2012/0252283 A1 * 10/2012 Muro ..... H01R 13/113 439/839
2012/0289100 A1 * 11/2012 Ishida ..... H01R 13/113 439/858
2013/0260598 A1 * 10/2013 Chikusa ..... H01R 13/4223 439/357
2013/0288546 A1 * 10/2013 Okano ..... H01R 13/113 439/852
2013/0288547 A1 * 10/2013 Amano ..... H01R 13/11 439/852
2013/0288548 A1 * 10/2013 Amano ..... H01R 13/187 439/852
2014/0287634 A1 * 9/2014 Tsuji ..... H01R 13/187 439/852
2014/0287635 A1 * 9/2014 Tsuji ..... H01R 13/113 439/852
2015/0087192 A1 * 3/2015 Tanigawa ..... H01R 13/187 439/852

(56) References Cited

U.S. PATENT DOCUMENTS

| | | | | |
|---|---|---|---|---|
| 2015/0263456 | A1* | 9/2015 | Hashimoto | H01R 13/113 439/752.5 |
| 2016/0006143 | A1* | 1/2016 | Chikusa | H01R 4/48 439/816 |
| 2016/0013569 | A1* | 1/2016 | Chikusa | H01R 13/113 439/816 |

FOREIGN PATENT DOCUMENTS

| | | |
|---|---|---|
| JP | 2003-243076 | 8/2003 |
| JP | 2004-362832 | 12/2004 |
| JP | 2006-236899 | 9/2006 |
| JP | 2009-54504 | 3/2009 |

* cited by examiner

FEMALE TERMINAL FITTING

BACKGROUND

1. Field of the Invention

The present invention relates to a female terminal fitting.

2. Description of the Related Art

A female terminal fitting disclosed in Japanese Unexamined Patent Publication No. 2003-243076 includes a tubular main body portion (called an "electrical contact portion" Japanese Unexamined Patent Publication No. 2003-243076) into which a male tab is to be inserted, and a resilient contact piece deflectably arranged in the main body portion and to be resiliently brought into contact with the male tab (called a "male terminal" in Japanese Unexamined Patent Publication No. 2003-243076) inserted into the main body portion. Further, a part of a side wall of the main body portion is cut and bent inwardly to prevent excessive deflection of the resilient contact piece, thereby forming an excessive deflection preventing piece.

In the above case, since a hole is made on the side wall as the excessive deflection preventing portion is formed, there has been a possibility that an external matter enters the main body portion through the hole. Particularly, since the above hole is located near a contact portion where the resilient contact piece comes into contact with the male tab, there has been a possibility that an external matter having entered through the hole adheres to the contact portion and electrical connection reliability might be impaired.

The present invention was completed based on the above situation and aims to provide a female terminal fitting capable of preventing excessive deflection of a resilient contact piece even without making a hole on a side wall of a main body portion.

SUMMARY OF THE INVENTION

The present invention is directed to a female terminal fitting with a tubular main body portion into which a mating male tab is to be inserted, and a resilient contact piece deflectably arranged in the main body portion, the resilient contact piece being resiliently deformed toward a base wall of the main body portion to resiliently come into contact with the male tab when the male tab is inserted into the main body portion, wherein an excessive deflection regulating piece for regulating excessive deflection of the resilient contact piece by coming into contact with the base wall of the main body portion is integrally provided to the resilient contact piece, an auxiliary spring piece cantilevered in a direction opposite to an inserting direction of the male tab is deflectably arranged in the main body portion, a spring force of the resilient contact piece is assisted by the contact of a free end part of the auxiliary spring piece with the resilient contact piece in a deflecting direction thereof, and the excessive deflection regulating pieces are formed by bending parts of the resilient contact piece protruding outwardly in a width direction toward the base wall of the main body portion and arranged to be proximate to opposite widthwise side edges of the free end part of the auxiliary spring piece and face and cover the opposite widthwise side edges.

Since the excessive deflection regulating piece for regulating the excessive deflection of the resilient contact piece is integrally provided to the resilient contact piece, the excessive deflection of the resilient contact piece can be prevented even without making a hole on a side wall of the main body portion. By the contact of the excessive deflection regulating pieces paired on the opposite widthwise sides of the resilient contact piece with the base wall, an excessive deflection movement of the resilient contact piece is stably regulated. Further, even if the auxiliary spring piece is going to excessively swing in the width direction, the excessive deflection regulating pieces come into contact with the auxiliary spring piece to regulate any further swing of the auxiliary spring piece. As a result, it is guaranteed that the auxiliary spring piece comes into contact with the resilient contact piece at a proper position. Further, a deflection movement of the auxiliary spring piece can be guided by the excessive deflection regulating pieces. The swing of the auxiliary spring piece is effectively suppressed at the free end part having a large swing amount when the auxiliary spring piece swings in the width direction. As a result, the stability of the deflection movement of the auxiliary spring piece is ensured.

A bent tip part of the excessive deflection regulating piece may contact the base wall of the main body portion. Accordingly, an excessive deflection amount of the resilient contact piece can be appropriately adjusted by adjusting a bending amount of the excessive deflection regulating piece.

The resilient contact piece may be cantilevered in an inserting direction of the male tab, and the excessive deflection regulating piece is provided on a free end part of the resilient contact piece. An excessive deflection movement of the resilient contact piece is more stably regulated by the contact of the excessive deflection regulating piece provided on the free end part of the resilient contact piece with the base wall.

The resilient contact piece may be wider on a base end part side than on the free end part. In this way, a resilient force reduction of the resilient contact piece is avoided and the free end part of the resilient contact piece does not largely protrude outwardly in the width direction due to the presence of the excessive deflection regulating piece.

DETAILED DESCRIPTION

One embodiment of the present disclosure is described in detail with reference to FIGS. 1 to 5. A female terminal fitting 10 of this embodiment is formed such as by bending an electrically conductive metal plate and includes a main body portion 20 for receiving a mating male tab 90 and a resilient contact piece 21 deflectably arranged in the main body portion 20. Note that although the female terminal fitting 10 includes a part to be connected to a wire behind the main body portion 20, this part is neither described nor shown here.

Figure 2:
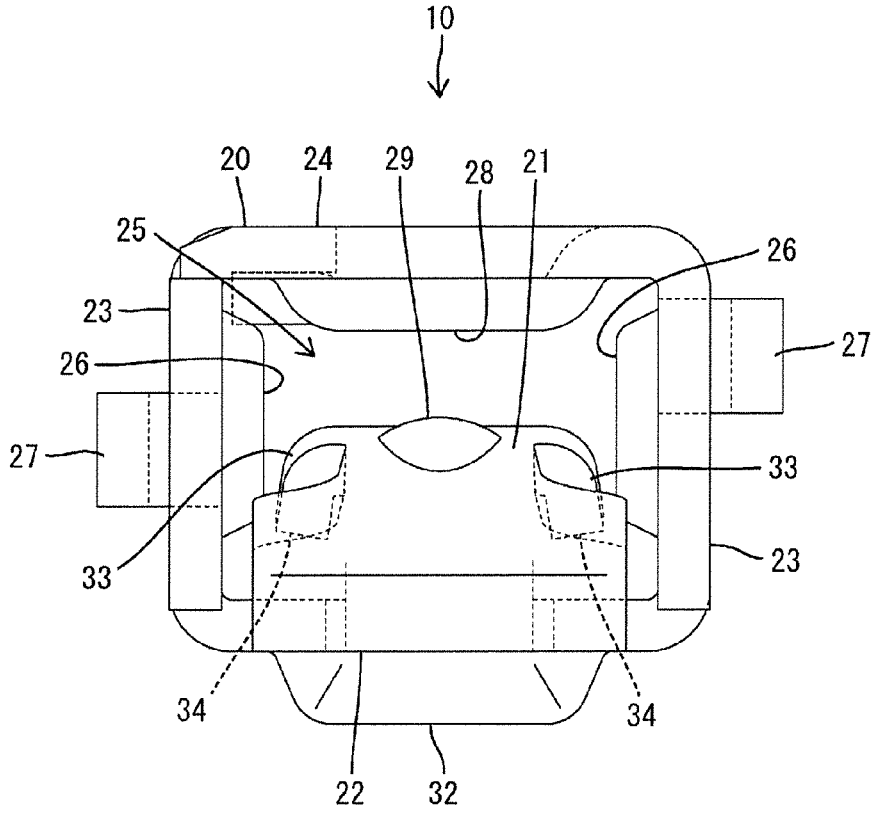
FIG. 2 is a front view of the main body portion.
Figure 3:
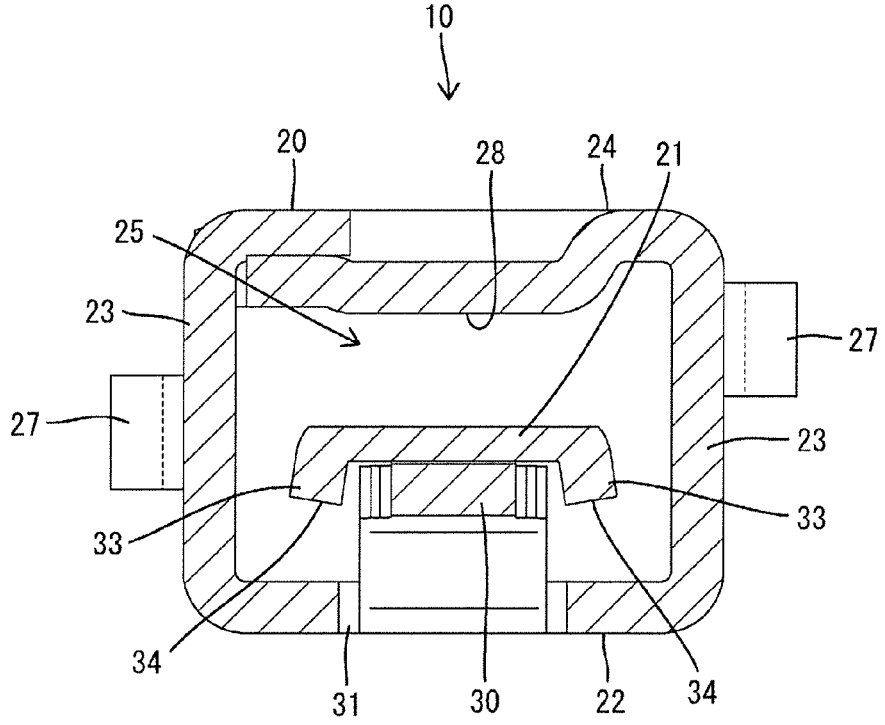
FIG. 3 is a front view in section of the main body portion.

The main body portion 20 is in the form of a rectangular tube penetrating in a front-back direction and, as shown in FIGS. 2 and 3, includes a base wall 22 extending substantially along a width direction, a pair of side walls 23 standing up from opposite side edges of the base wall 22 (opposite ends in the width direction) and a facing wall 24 bridged from the upper end of one of the both side walls 23 to the upper end of the other. A tab insertion space 25 into which the male tab 90 (see FIG. 5) is to be inserted is secured in the main body portion 20.

Figure 1:
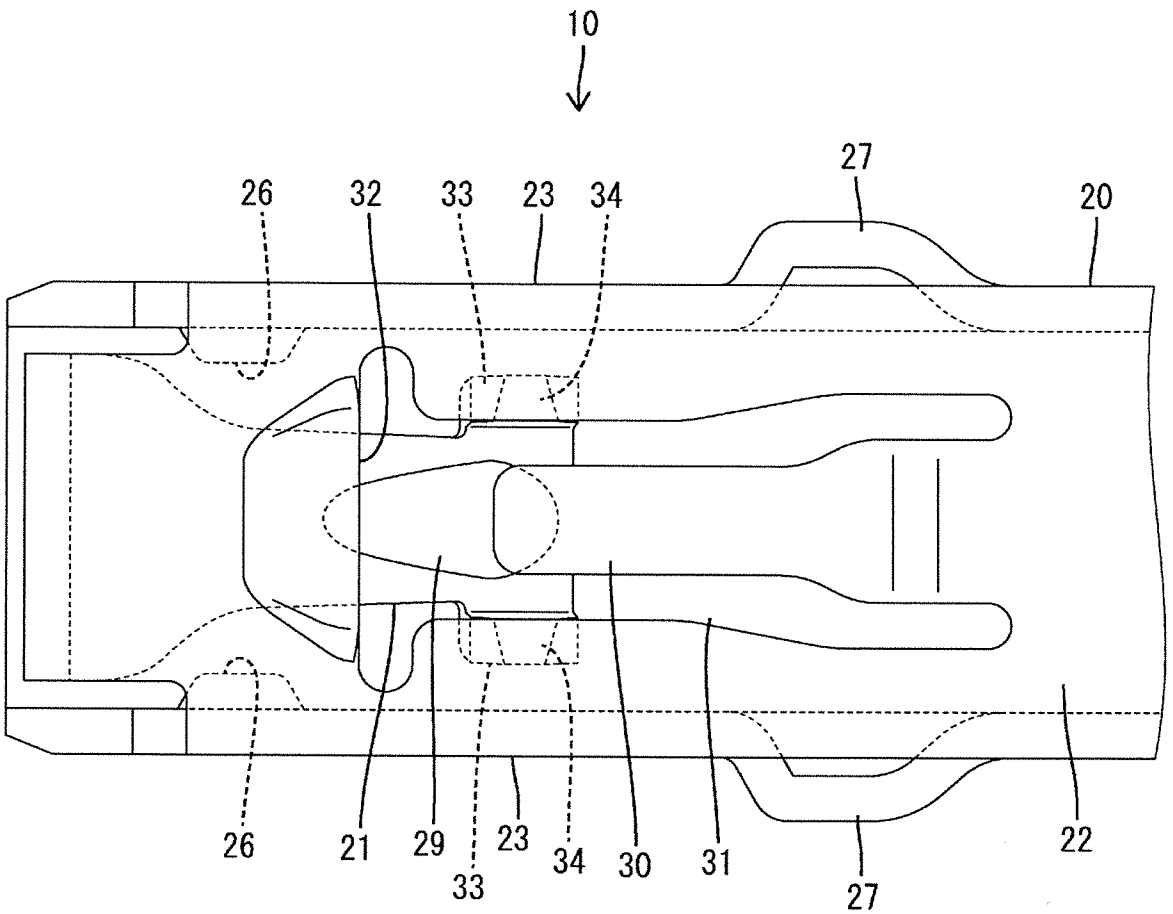
FIG. 1 is a bottom view of a main body portion in a female terminal fitting of one embodiment of the present invention.

As shown in FIGS. 1 and 2, a pair of backlash preventing portions 26 bulging inwardly of the main body portion 26 are provided on front end parts of the both side walls 23. Parts of the both side walls 23 are struck to project inwardly, thereby forming the both backlash preventing portions 26. When the male tab 90 is inserted into the main body portion 20, the both backlash preventing portions 26 are arranged proximately to opposite outer ends of the male tab 90 in the width direction, whereby loose movements of the male tab 90 in the width direction are regulated.

Further, as shown in FIGS. 1 and 2, a pair of stabilizers 27 projecting outwardly of the main body portion 20 are provided on rear end parts of the both side walls 23. The both stabilizers 27 are formed by cutting parts of the both side walls 23 and bending the cut parts outwardly, and arranged at height positions of the both side walls 23 different from each other. Here, the female terminal fitting 10 is inserted into a cavity (not shown) of a connector housing. In this case, the both stabilizers 27 are fitted into guiding grooves (not shown) communicating with the cavity to guide an insertion movement of the female terminal fitting 10, whereas it can be known that an insertion posture of the female terminal fitting 10 is not correct if the both stabilizers 27 cannot be fitted into the guiding grooves. Note that the both side walls 23 include no opening parts such as holes except slits formed as the both stabilizers 27 are formed by cutting and bending and the slits are arranged at positions distant from a later-described contact portion 29 of the resilient contact piece 21.

Figure 4:
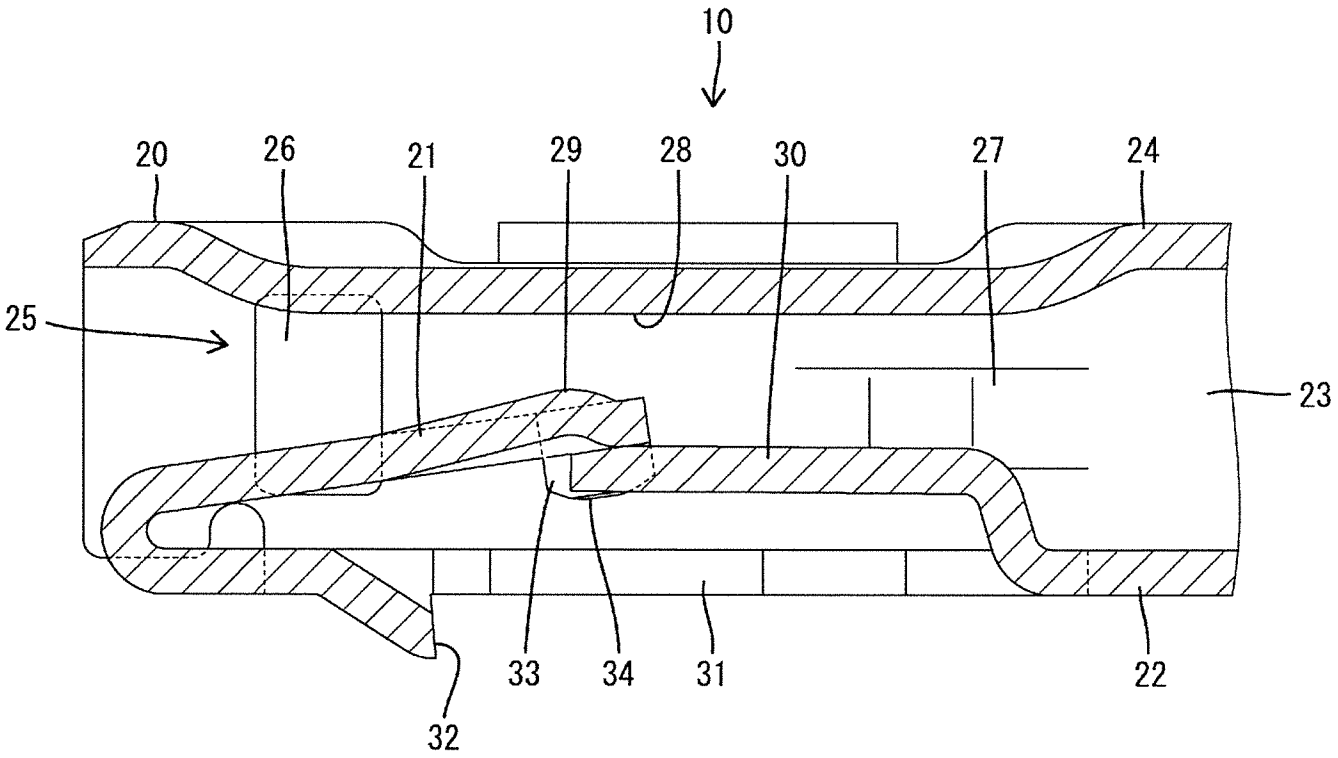
FIG. 4 is a side view in section of the main body portion.

As shown in FIGS. 2 and 4, a part of the facing wall 24 is recessed inwardly to form a receiving portion 28. The inner surface of the receiving portion 28 is arranged along the front-back direction and can come into contact with the upper surface of the male tab 90 inserted into the main body portion 20.

The resilient contact piece 21 is formed by folding a part extending forward from the front end of the base wall 22 in a development state backward (inserting direction of the male tab 90) and extends backward substantially at an upward inclination from the front end of the base wall 22 as shown in FIG. 4. The resilient contact piece 21 is deflectable and deformable in a vertical direction with a front end part (base end part) connected to the base wall 22 as a supporting point. As shown in FIG. 1, the front end part of the resilient contact piece 21 is wider than a part behind it. Further, as shown in FIGS. 2 and 4, the embossed contact portion 29 is formed to bulge upwardly in a widthwise central part of a rear end part (free end part) of the resilient contact piece 21.

As shown in FIG. 4, a deflectable auxiliary spring piece 30 is provided in the main body portion 20 separately from the resilient contact piece 21. The auxiliary spring piece 30 is formed on the base wall 22 by cutting and bending while leaving a hole 31. The auxiliary spring piece 30 extends substantially horizontally after obliquely extending forward (direction opposite to the inserting direction of the male tab 90) at an upward inclination from the rear end, and is deflectable and deformable in the vertical direction with a rear end part connected to the base wall 22 as a supporting point. A front end part (free end part) of the auxiliary spring piece 30 is arranged in contact with the rear end part of the resilient contact piece 21 from below and a spring force of the resilient contact piece 21 is assisted by the resilient contact piece 21 being resiliently supported from below by the auxiliary spring piece 30. Note that, as shown in FIG. 1, the auxiliary spring piece 30 is narrower than the resilient contact piece 21 as a whole and the front end part of the auxiliary spring piece 30 can come into contact with a widthwise central part of the rear end part of the resilient contact piece 21.

Further, as shown in FIGS. 1 and 4, the base wall 22 is provided with a locking projection 32 before the auxiliary spring piece 30. The locking projection 32 is formed by cutting a part of the base wall 22 and bending the cut part via the hole 31, and in the form of a claw projecting downwardly of the base wall 22. When the female terminal fitting 10 is inserted into the cavity of the connector housing, a locking lance (not shown) projecting at an inner wall of the cavity is arranged to be lockable to the locking projection 32, whereby the female terminal fitting 10 is retained in the cavity.

Figure 5:
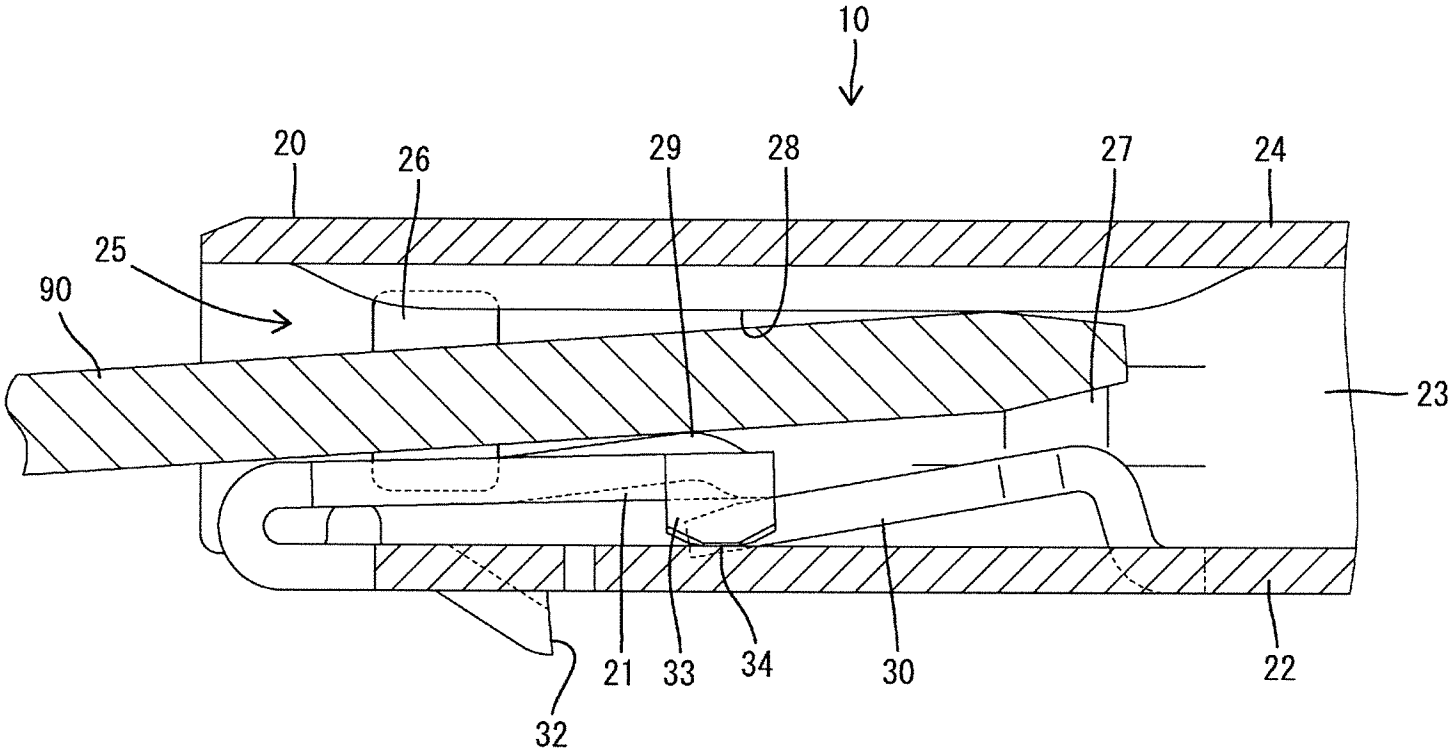
FIG. 5 is a view showing a state where excessive deflection of a resilient contact piece is regulated by excessive deflection regulating pieces when a male tab in a wrong posture is inserted into the main body portion.

As shown in FIGS. 1 and 2, a pair of excessive deflection regulating pieces 33 are integrally provided to opposite side edges (opposite widthwise ends) of the rear end part of the resilient contact piece 21 at a position overlapping the contact portion 29 in the front-back direction. The both excessive deflection regulating pieces 33 are formed by bending opposite parts of the rear end part of the resilient contact piece 21 protruding laterally outwardly downwardly, i.e. toward a side where the base wall 22 is located. Specifically, the both excessive deflection regulating pieces 33 are in the form of plate pieces and lower end parts (bent tip parts) thereof are formed into such a substantially trapezoidal shape in a side view that a width in the front-back direction is gradually narrowed toward the lower edge as shown in FIG. 5. The lower edges of the lower end parts of the both excessive deflection regulating pieces 33 serve as contact edges 34 to be brought into contact with the inner surface of the base wall 22 when the resilient contact piece 21 is going to be excessively deflected and deformed as described later (see FIG. 5). Further, as shown in FIGS. 2 and 3, the both excessive deflection regulating pieces 33 extend downward in directions to be separated from each other while being inclined at a slight angle with respect to the vertical direction.

Further, as shown in FIG. 3, the both excessive deflection regulating pieces 33 are arranged to be proximate to opposite side edges of the front end part of the auxiliary spring piece 30 and face and cover those opposite side edges of the front end part. Since the rear end part of the resilient contact piece 21 is arranged in contact with the upper surface of the front end part of the auxiliary spring piece 30, the front end part of the auxiliary spring piece 30 is surrounded on three sides by the rear end part of the resilient contact piece 21 and the both excessive deflection regulating pieces 33.

The structure of the female terminal fitting 10 of this embodiment is as described above. Next, functions and effects of the female terminal fitting 10 are described.

When the connector housing is connected to a mating connector housing (both are not shown), the male tab 90 mounted in the mating connector housing is inserted into the main body portion 20 of the female terminal fitting 10 accommodated in the cavity of the connector housing. In the process of inserting the male tab 90, the male tab 90 slides on the contact portion 29 of the resilient contact piece 21 to deflect and deform the resilient contact piece 21 downwardly and the auxiliary spring piece 30 is also deflected and deformed downwardly by being pressed by the resilient contact piece 21. In this case, if the front end part of the auxiliary spring piece 30 is going to swing in the width direction, one side edge of the front end part of the auxiliary spring piece 20 comes into contact with the corresponding excessive deflection regulating piece 33 facing in a swinging direction, whereby any further swing (loose movement) of the auxiliary spring piece 30 is suppressed. As a result, a state where the auxiliary spring piece 30 is in contact with the resilient contact piece 21 at a proper position is ensured and the auxiliary spring piece 30 is prevented from being inadvertently brought out of contact with the resilient contact piece 21. Simultaneously, the swing of the resilient contact piece 21 in the width direction is also suppressed, with the result that the resilient contact piece 21 is smoothly deflected.

Further, if the male tab 90 is inserted into the main body portion 20 in a state inclined with respect to a proper insertion posture as shown in FIG. 5, the resilient contact piece 21 may be deflected and deformed more than a normal deflection amount by being pressed by this male tab 90 in the oblique posture. However, according to this embodiment, the contact edges 34 of the both excessive deflection regulating pieces 33 come into contact with parts of the inner surface of the base wall 22 at opposite widthwise sides of the hole 31 to hinder any further deflection of the resilient contact piece 21 when the resilient contact piece 21 assumes a posture substantially along the front-back direction immediately before being excessively deflected and deformed (see FIG. 5). Thus, the resilient contact piece 21 is prevented from being excessively deflected and deformed and, simultaneously, the auxiliary spring piece 30 is also prevented from being excessively deflected and deformed. On the other hand, if the female terminal fitting 10 is in the proper posture and the connector housing is properly inserted into the mating connector housing, the resilient contact piece 21 is properly held in contact with the male tab 90 to be electrically conductively connected.

As described above, according to this embodiment, the excessive deflection of the resilient contact piece 21 can be prevented even without making a hole or the like on the side wall 23 of the main body portion 20 since the excessive deflection regulating pieces 33 are provided on the resilient contact piece 21 itself. Further, since the excessive deflection regulating pieces 33 are formed by bending the rear end part of the resilient contact piece 21 and the lower end parts (bent tip parts) of the excessive deflection regulating pieces 33 can come into contact with the base wall 22, an excessive deflection amount of the resilient contact piece 21 can be appropriately adjusted by adjusting the excessive deflection regulating pieces 33 in length.

Further, since the pair of excessive deflection regulating pieces 33 are arranged at the opposite widthwise sides of the auxiliary spring piece 30, a deflection movement of the auxiliary spring piece 30 can be guided and, in addition, the auxiliary spring piece 30 is prevented from being brought out of contact with the resilient contact piece 21. Furthermore, since the pair of excessive deflection regulating pieces 33 are arranged at the opposite widthwise sides of the front end part of the auxiliary spring piece 30, the swing of the auxiliary spring piece 30 is effectively suppressed on the front end part of the auxiliary spring piece 30 having a large swing amount when the auxiliary spring piece 30 swings in the width direction, wherefore stability in a deflection movement of the auxiliary spring piece 30 is ensured.

The present invention is not limited to the above described and illustrated embodiment. For example, the following modes are also included in the technical scope of the present invention.

Only one excessive deflection regulating piece may be provided or three or more excessive deflection regulating pieces may be provided.

The excessive deflection regulating piece may be formed on the rear end edge of the resilient contact piece by bending.

The excessive deflection regulating piece may be provided before the rear end part of the resilient contact piece.

Conversely to the embodiment, the resilient contact piece may extend forward from the rear end of the base wall and be deflectable and deformable with the rear end as a supporting point.

The excessive deflection regulating piece may be formed by striking a part of the resilient contact piece toward the base wall.

LIST OF REFERENCE SIGNS

10 . . . female terminal fitting
20 . . . main body portion
21 . . . resilient contact piece
22 . . . base wall
23 . . . side wall
29 . . . contact portion
30 . . . auxiliary spring piece
33 . . . excessive deflection regulating piece
90 . . . male tab

The invention claimed is:

1. A female terminal fitting with a tubular main body portion into which a mating male tab is to be inserted, and a resilient contact piece deflectably arranged in the main body portion, the resilient contact piece being resiliently deformed toward a base wall of the main body portion to resiliently come into contact with the male tab when the male tab is inserted into the main body portion, wherein:

an excessive deflection regulating piece for regulating excessive deflection of the resilient contact piece by coming into contact with the base wall of the main body portion is integrally provided to the resilient contact piece; and an auxiliary spring piece cantilevered in a direction opposite to an inserting direction of female tab is deflectably arranged in the main body portion, a spring force of the resilient contact piece is assisted by the contact of a free end part of the auxiliary spring piece with the resilient contact piece in a deflecting direction thereof, and the excessive deflection regulating pieces are formed by bending parts of the resilient contact piece protruding outwardly in a width direction toward the base wall of the main body portion and arranged to be proximate to opposite widthwise side edges of the free end part of the auxiliary spring piece and face and cover the opposite widthwise side edges.

2. The female terminal fitting of claim 1, wherein bent tip parts of the excessive deflection regulating piece come into contact with the base wall of the main body portion.

3. The female terminal fitting of claim 2, wherein the resilient contact piece is cantilevered in an inserting direction of the male tab, and the excessive deflection regulating piece is provided on a free end part of the resilient contact piece.

4. The female terminal fitting of claim 3, wherein the resilient contact piece is wider on a base end part side than on the free end part.

5. The female terminal fitting of claim 1, wherein the resilient contact piece is cantilevered in an inserting direction of the male tab, and the excessive deflection regulating piece is provided on a free end part of the resilient contact piece.

* * * * *